United States Patent [19]

Tallent et al.

[11] 4,394,269

[45] Jul. 19, 1983

[54] METHOD FOR CLEANING SOLUTION USED IN NUCLEAR FUEL REPROCESSING

[75] Inventors: Othar K. Tallent, Oak Ridge; Karen E. Dodson, Knoxville; James C. Mailen, Oak Ridge, all of Tenn.

[73] Assignee: The United States of America as represented by the United States Department of Energy, Washington, D.C.

[21] Appl. No.: 262,831

[22] Filed: May 12, 1981

[51] Int. Cl.[3] ..... G21F 9/12

[52] U.S. Cl. ..... 210/690; 252/631; 423/10; 423/6

[58] Field of Search ..... 423/6, 10; 252/631, 252/454; 210/690

[56] References Cited

U.S. PATENT DOCUMENTS 3,112,275 11/1963 Pollock et al. ..... 252/631

OTHER PUBLICATIONS

Goldacker, Schmieder, Steinbrunn, Stieglitz, "A Newly Developed Solvent Wash Process in Nuclear Fuel Reprocessing Decreasing the Waste Volume," Kerntechnik 18, 426, (1976).

*Primary Examiner*—Deborah L. Kyle
*Assistant Examiner*—Catherine S. Kilby
*Attorney, Agent, or Firm*—Edwin D. Grant; Stephen D. Hamel; Richard G. Besha

[57] ABSTRACT

A nuclear fuel processing solution containing (1) hydrocarbon diluent, (2) tri-n-butyl phosphate or tri-2-ethylhexyl phosphate, and (3) monobutyl phosphate, dibutyl phosphate, mono-2-ethylhexyl phosphate, di-2-ethylhexyl phosphate, or a complex formed by plutonium, uranium, or a fission product thereof with monobutyl phosphate, dibutyl phosphate, mono-2-ethylhexyl phosphate, or di-2-ethylhexyl phosphate is contacted with silica gel having alkali ions absorbed thereon to remove any one of the degradation products named in section (3) above from said solution.

3 Claims, 1 Drawing Figure

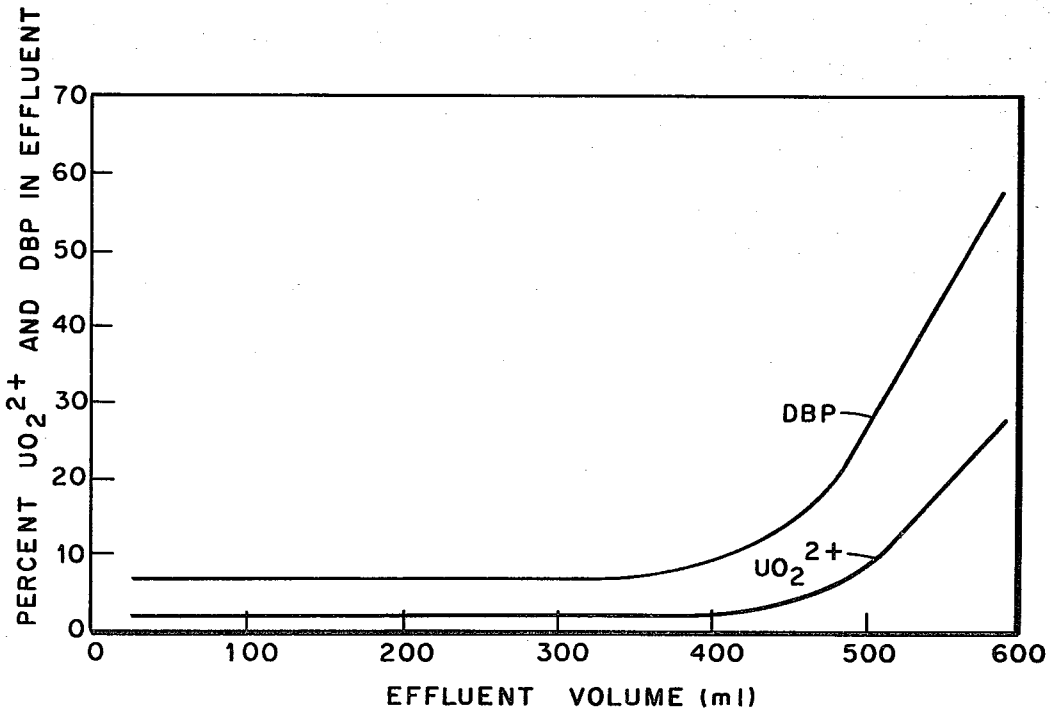
PERCENT $UO_2^{2+}$ AND DBP IN EFFLUENT
70
60
50
40
30
20
10
0
0
100
200
300
400
500
600
EFFLUENT VOLUME (ml)
DBP
$UO_2^{2+}$

METHOD FOR CLEANING SOLUTION USED IN NUCLEAR FUEL REPROCESSING

BACKGROUND OF THE INVENTION

This invention, which was made under a contract with the United States Department of Energy, relates in general to a process useful in the reclamation of components of spent nuclear fuel and, more particularly, to a method for removing degradation products from a solution commonly used for reclaiming plutonium and uranium from a nitric acid solution in which spent nuclear fuel is dissolved.

The 30% tri-n-butyl phosphate (TBP), 70% dodecane solution used in nuclear fuel reprocessing undergoes degradation in use, forming monobutyl phosphate and dibutyl phosphate which then form complexes with small quantities of plutonium, uranium, and their fission products that are not removed from the solution in the primary nuclear fuel reclaiming process. Recycle of TBP solvent for further use requires the removal of these degradation products, and various methods have been proposed for this purpose, including washing the solvent with $Na_2CO_3$ or $N_2H_4.H_2CO_3$ solutions or passing the solvent through a column containing solid adsorbents such as macroreticular resins, hydrous $TiO_2$, and mixed $SiO_2$ and $PbO_2$. The use of $Na_2CO_3$ produces large amounts of waste material that causes a disposal problem. The $N_2H_4.H_2CO_3$ method presents problems in the preparation and storage of the $N_2H_4.H_2CO_3$ solution used therein. A resin adsorbent works well only with acid-free solvents. $TiO_2$ is presently used only on an experimental scale, and mixed $SiO_2$ and $PbO_2$ have only been reported as being used for secondary removal of degradation products from solutions previously treated by standard wash solutions.

SUMMARY OF THE INVENTION

It is therefore an object of this invention to provide an efficient and convenient method for decontaminating a nuclear metal extracting solution containing a hydrocarbon diluent, tri-n-butyl phosphate or tri-2-ethylhexyl phosphate, and a degradation product of one of the named phosphates.

Another object of the invention is to clean a TBP solution without producing waste products that are difficult to dispose of.

These objects and other advantages are achieved, in accordance with the invention, by contacting a contaminated actinide metal extracting solution with silica gel having alkali metal ions such as sodium or lithium adsorbed thereon, thereby adsorbing impurities in the solution on the gel, which can then be disposed of as an easily handled solid or which can be washed and recycled for further use as a cleaning medium.

BRIEF DESCRIPTION OF THE DRAWING

The drawing is a graph showing the amount of $UO_2^{2+}$ and dibutyl phosphate present in effluent obtained from a column of treated silica gel through which is passed a contaminated extractant solution described with particularity hereinafter.

DETAILED DESCRIPTION

The treated silica gel useful for the process of this invention can be prepared by soaking the gel in an aqueous solution of NaOH or LiOH for about 24 hours, after which the gel is filtered, air dried, washed with water, and again air dried. This treatment results in the adsorption of $Na^+$, $Li^+$, and $OH^-$ ions on the surface of the gel and increases the gel surface charge. Tests made by the inventors have shown that the capacity of the treated gel to clean TBP solvent increases with the amount of sodium or lithium adsorbed on the gel, the principal factor which determines the amount of the alkali metal adsorbed on the gel being the specific surface area of the latter. It is therefore preferable, so far as is practical while maintaining a desired flow rate through a column, to use a silica gel having a small particle size, and concomitantly a large surface area, to increase the gel adsorption capacity. A number of commercially available silica gels with mesh sizes up to 100–200 mesh have been effectively used in tests made by the inventors.

The principal impurities removed from TBP solvent by the process of this invention are monobutyl phosphate, dibutyl phosphate, $UO_2^{2+}$, $Pu^{4+}$, and fission products of plutonium and uranium complexed with monobutyl phosphate or dibutyl phosphate. Nitric acid is also removed from the TBP solution by the treated silica gel. Conventional adsorption column techniques are applicable for the process of the invention.

One option for disposal of silica gel loaded with the above-named impurities by the process of the invention is to treat the gel as waste. For example, the loaded gel can be incorporated into glass bricks for convenient handling and storage. Another disposal option is to wash adsorbed impurities off the gel and then recycle it into further contact with contaminated TBP solution. Suitable solutions for eluting the gel are one containing 30% TBP and 70% hydrocarbon diluent, $HNO_3$, and aqueous $HNO_3$.

Tri-2-ethylhexyl phosphate in a hydrocarbon diluent is being considered as an alternative to TBP for use in recovering uranium and plutonium from nitric acid nuclear fuel dissolving solutions. The mono-2-ethylhexyl phosphate and di-2-ethylhexyl phosphoric acid degradation products formed from this alternative extractant are extremely difficult to clean from the extractant by use of conventional sodium carbonate washing due to emulsion problems. However, the treated silica gel used in the process of this invention has been found to be effective for removing the mono-2-ethylhexyl phosphoric acid and the di-2-ethylhexyl phosphoric acid product from a tri-2-ethylhexyl phosphate and hydrocarbon diluent solution. The adsorption capacity of the treated gel for removing the last-named degradation products of tri-2-ethylhexyl phosphate is less than that of the gel for removing the degradation products of TBP because of the larger molecular size of the former compared to the latter.

Use of the herein disclosed treated silica gel for removing contaminants from a solution of a hydrocarbon diluent and either tri-n-butyl phosphate or tri-2-ethylhexyl phosphate provides the following advantages:

1. The gel minimizes the problem of waste disposal associated with the sodium carbonate wash method of decontaminating a DBP solution.

2. The use of the gel eliminates the problems of gassing, emulsion, slow phase separations, formation of insoluble material at interfaces of phases, and entrainment between phases that occur when wash solutions are used for decontaminating extractant solutions.

3. The gel requires a much smaller storage volume than a wash liquid.

4. Wash methods require neutralization of acid in the extractant solution, which results in precipitation problems that are eliminated by use of the gel of the invention. Furthermore, the treated silica gel acts as a filter for the extractant solution so that other filters are not needed.

5. Treated silica gel is less subject to chemical and radiation damage than the macroreticular resins previously used as adsorbents for the contaminants in extractant solutions, and the gel can easily be eluted whereas macroreticular resins are eluted with difficulty.

6. The column flow rate usable with the method of this invention is at least twice that reported for hydrous titanium decontamination columns.

7. The use of treated silica gel for cleaning an extractant solution eliminates problems of toxicity and explosion that are involved with the use of hydrazine compounds as cleaning agents.

8. Lastly, the gel used in accordance with this invention is more effective for cleaning an extractant solvent than the wash or macroreticular cleaning means.

The following test examples specifically illustrate the process of this invention.

EXAMPLE I

The following is a description of a solvent cleanup test using silica gel treated with LiOH in which silica gel column loading, elution, and regeneration are demonstrated.

A batch of 6-16 mesh silica gel (Fisher Scientific Grade 05) was soaked for 24 h in a volume of 1.0 M NaOH solution such that 2 millimoles of LiOH were present in the solution per gram of silica gel. The gel was filtered, air dried, washed with a volume of water equal to the initial volume of LiOH solution, and again air dried. Analyses showed that the treated silica gel solids contained 250 mg of water and 7.3 mg of lithium per gram of gel. A 30% TBP approximately 70% hydrocarbon feed solvent containing $1.5\times10^{-3}$ M $UO_2^{2+}$, $2.70\times10^{-3}$ M dibutyl phosphate (DBP), approximately $3.0\times10^{-4}$ M monobutyl phosphate (MBP), and slightly less than $5\times10^{-3}$ M $HNO_3$ was fed at a rate of 0.4 ml/min into a 1.0 cm diameter column containing 17.5 ml (15.7 g) of the above described pretreated silica gel at approximately 40° C. Slight breakthrough of the DBP into the effluent began after 1250 ml of feed had passed through the column, and slight breakthrough of $UO_2^{2+}$ occurred after 1500 ml of feed had passed through. The column was drained after the $UO_2^{2+}$ began to break through and eluted with 150 ml of 0.25 M $HNO_3$ aqueous solution at a 0.4 ml/min flow rate. It was found that 13 ml of the organic solvent which had adhered to the gel surface came off the column with the 150 ml of aqueous elution. At this point, the silica gel in the column was regenerated by a treatment in which each of two 25 ml volumes of 0.5 M LiOH were allowed to stand in the column for 4 h. Any DBP not eluted previously is eluted in this step. The column was drained, lightly dried with a stream of air, and filled with pure 30% TBP--70% normal paraffin hydrocarbon solvent (hereinafter referred to as NPH). The column was used in two additional loading, elution, and regeneration cycles similar to the above except that the elutions were with 100 ml volumes of 30% TBP, approximately 70% NPH, 0.6 M $HNO_3$ solvent.

The average loading on the silica gel column in the three cycles was approximately 0.19 millimoles of $UO_2^{2+}$ and 0.29 millimoles of DBP per gram dry weight of the silica gel. On the average approximately 98% of the $UO_2^{2+}$ and 92% DBP was eluted in each cycle. In the regeneration step, an average of approximately 1.0 millimole of lithium was adsorbed per gram of moist silica gel. This is approximately the quantity of lithium adsorbed per gram in the original preparation of the solid sorbent.

EXAMPLE II

The following is a description of a solvent cleanup test which is typical of several tests conducted using silica gel treated with sodium hydroxide (NaOH) solutions.

A column the same size as in Example 1 was filled with 17.0 g of silica gel the same as Example 1 except that it was pretreated with NaOH solution instead of LiOH solution. The pretreated gel contained 236 mg of $H_2O$ and 20.4 mg of sodium per gram of gel. A 30% TBP approximately 70% NPH feed solvent containing $4.6\times10^{-3}$ M $UO_2^{2+}$, $8.0\times10^{-3}$ M DBP, and less than $5.0\times10^{-3}$ M $HNO_3$ was fed into the column at 40° C. at a rate of 0.3 ml/min. The $UO_2^{2+}$ and DBP effluent breakthrough curves are shown in the accompanying drawing. As can be seen, 400 ml of solvent was put through the column before there was significant breakthrough of the $UO_2^{2+}$ and DBP in the effluent. Average loading on the column amounted to 0.14 millimoles of $UO_2^{2+}$ and 0.23 millimoles of DBP per gram dry weight of the silica gel. It is estimated from extrapolation of the data in the drawing that 0.22 millimoles of $UO_2^{2+}$ and 0.31 millimoles of DBP would be loaded per gram dry weight of silica gel at 100% breakthrough of these constituents into the effluent.

The approximate 26,000 liters of solvent used in processing one metric ton of nuclear fuel is estimated to contain approximately 26 mol each of $UO_2^{2+}$ and DBP. The estimated amount of sodium required to clean up 26,000 liters of such solvent using the silica gel method based on the above loading values would be approximately 3 kg. It has been estimated that 25 kg of sodium or approximately 100 kg of sodium nitrate is produced as waste using the sodium carbonate wash solvent cleanup method.

Other tests were conducted identically to the above test except at faster feed flow rates. From these tests, it was shown that the capacity of the silica gel to load $UO_2^{2+}$ and DBP was unchanged at flow rates up to 1.1 ml/min. The capacity was decreased by approximately 40% at a rate of 1.7 ml/min.

EXAMPLE III

This is a description of tests to clean up irradiated solvent (30% TBP approximately 70% NPH). The test solvent had been used to extract uranium and plutonium from a dissolver solution of H. B. Robinson-2 reactor fuel. After the extractions, the loaded solvent was contacted with nitrous acid solution to remove easily stripped plutonium and with 0.01 M $HNO_3$ solution to remove easily stripped uranium. In a process the stripped solvent at this point would be sent to solvent cleanup. The respective gross alpha and gross gamma activities retained in the stripped solvent were $4.8\times10^4$ and $7.4\times10^3$ c/m/ml and the respective DBP, $UO_2^{2+}$, and $H^+$ concentrations were $3\times10^{-4}$ M, $4.45\times10^{-3}$ M, and $1.0\times10^{-2}$ M. The alpha activity was primarily from $^{239}Pu$ and the gamma activity primarily from fission product metal ions. A 270 ml volume of the stripped solvent was passed through a 1.0 cm diameter column containing 15 ml of silica gel (pretreated as described in Example II) at a rate of approximately 1.0 m/min. The gross alpha and gross gamma activities in the effluent solvent were decreased to less than 20 c/m/ml and less than 400 c/m/ml, respectively. The DBP concentration was decreased to $5\times10^{-5}$ M and the MBP concentration was below the limits of detection (less than $1\times10^{-5}$ M). Decontamination factors obtained for the solvent in the silica gel column are shown in Table 1. Decontamination factors for sodium and hydrazine carbonate equal volume wash tests are also shown. The gross alpha decontamination factor obtained by the column treatment was approximately 1200 times greater than that obtained in the wash tests. The gross gamma decontamination factor was only slightly greater in the column tests.

TABLE I

Comparison of column tests[a] with aqueous wash tests[b] for solvent[c] cleanup

| Decontamination factor | Sodium carbonate 0.23 M | Hydrazine carbonate 0.23 M | Silica gel treated with NaOH |
|---|---|---|---|
| Gross alpha[d] | 2.0 | 1.9 | $2.4\times10^{+3}$ |

TABLE I-continued

Comparison of column tests[a] with aqueous wash tests[b] for solvent[c] cleanup

| Decontamination factor | Sodium carbonate 0.23 M | Hydrazine carbonate 0.23 M | Silica gel treated with NaOH |
|---|---|---|---|
| Gross gamma | 16.5 | 6.9 | 18 |

[a]Column contained 15 ml of treated silica gel, flow rate = 1.3 ml/min/cm$^2$ of column cross section surface area, temperature 40° C.
[b]Equal volume aqueous-organic equilibrations for 5 min, temperature 25° C.
[c]Solvent from tests using feed from H. B. Robinson fuel under LMFBR fuel processing conditions.
[d]Gross alpha approximately 98% $^{239}$Pu and $^{238}$Pu.

We claim:

1. A method of processing a solution containing (1) a hydrocarbon diluent, (2) a phosphate selected from the group consisting of tri-n-butyl phosphate and tri-2-ethylhexyl phosphate, and (3) a degradation product selected from the group consisting of (a) monobutyl phosphate, (b) dibutyl phosphate, (c) mono-2-ethylhexyl phosphate, (d) di-2-ethylhexyl phosphate, and (e) a complex of plutonium, uranium, or a fission product thereof with monobutyl phosphate, dibutyl phosphate, mono-2-ethylhexyl phosphate, or di-2-ethylhexyl phosphate, comprising contacting said solution with silica gel having alkali metal ions absorbed thereon.

2. The method of claim 1 wherein sodium ions are absorbed on said silica gel.

3. The method of claim 1 wherein lithium ions are absorbed on said silica gel.

* * * * *